US008276886B2

(12) United States Patent
Gripne et al.

(10) Patent No.: US 8,276,886 B2
(45) **Date of Patent: *Oct. 2, 2012**

(54) COMBINED GUARDRAIL AND CABLE SAFETY SYSTEMS

(75) Inventors: Don J. Gripne, Olympia, WA (US); Charles R. Norton, Farmington, UT (US); Elzard A. Sikkema, Murray, UT (US); Brian E. Smith, Dallas, TX (US)

(73) Assignee: Trinity Industries, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/172,341

(22) Filed: Jun. 29, 2011

(65) Prior Publication Data

US 2011/0253961 A1 Oct. 20, 2011

Related U.S. Application Data

(62) Division of application No. 12/113,514, filed on May 1, 2008, now Pat. No. 7,988,133.

(60) Provisional application No. 60/915,354, filed on May 1, 2007.

(51) Int. Cl.
*E01F 15/00* (2006.01)

(52) U.S. Cl. ..... 256/13.1

(58) Field of Classification Search ..... 256/13.1, 256/64, 52, 58; 52/146, 166; 404/6, 9, 10
See application file for complete search history.

(56) References Cited

U.S. PATENT DOCUMENTS

| | | | | |
|---|---|---|---|---|
| 1,643,555 | A | 9/1927 | Gledhill | |
| 1,930,985 | A | 10/1933 | Schulz | 256/13.1 |
| 2,005,418 | A * | 6/1935 | Hayden et al. | 256/13.1 |
| RE22,060 | E | 4/1942 | Hayden et al. | 256/13.1 |
| 2,317,248 | A | 4/1943 | Brickman | 256/13.1 |
| 2,317,249 | A | 4/1943 | Brickman | 248/66 |
| 2,907,552 | A | 10/1959 | Crone | 256/13.1 |
| 3,258,250 | A | 6/1966 | McMullin | 256/13.1 |
| 3,276,750 | A | 10/1966 | De Ridder | 256/13.1 |
| 5,011,326 | A | 4/1991 | Carney, III | 404/6 |
| 5,039,066 | A | 8/1991 | Stacey | 256/13.1 |
| 5,391,016 | A | 2/1995 | Ivey et al. | 404/6 |
| 5,876,020 | A * | 3/1999 | Giavotto | 256/13.1 |
| 6,561,492 | B1 | 5/2003 | Hubbell | 256/13.1 |
| 6,575,434 | B2 | 6/2003 | Bligh et al. | 256/13.1 |
| 7,182,320 | B2 | 2/2007 | Heimbecker et al. | 256/13.1 |
| 7,185,882 | B2 | 3/2007 | Buth et al. | 256/13.1 |
| 7,249,908 | B2 | 7/2007 | Bergendahl et al. | 404/6 |
| 7,398,960 | B2 * | 7/2008 | Neusch | 256/47 |
| 7,556,243 | B2 | 7/2009 | Williams | 256/13.1 |
| 7,686,535 | B2 * | 3/2010 | Bergendahl et al. | 404/6 |
| 7,988,133 | B2 * | 8/2011 | Gripne et al. | 256/13.1 |
| 2003/0222254 | A1 | 12/2003 | Bergendahl | 256/13.1 |
| 2005/0077507 | A1 | 4/2005 | Heimbecker et al. | 256/13.1 |
| 2006/0182495 | A1 | 8/2006 | Bergendahl et al. | 404/6 |
| 2006/0243954 | A1 | 11/2006 | Williams | 256/13.1 |
| 2008/0283806 | A1 | 11/2008 | Everitt et al. | 256/13.1 |

* cited by examiner

*Primary Examiner* — Joshua Kennedy
(74) *Attorney, Agent, or Firm* — Baker Botts L.L.P.

(57) ABSTRACT

A combined guardrail and cable safety system is disclosed. In one aspect, a safety barrier incorporating the teachings of the present disclosure may include a plurality of cable posts spaced from each other and disposed adjacent to a roadway. At least two cables may be releasably engaged with and supported by the cable posts. The cable posts and the at least two cables may cooperate with each other to prevent a vehicle from leaving the roadway. A plurality of guardrail posts may also spaced from each other and disposed adjacent to the roadway longitudinally spaced from the plurality of cable post. A box beam guardrail beam may be attached to the plurality of guardrail posts. The at least two cables may operably extend from the cable posts to engage respective cable anchor brackets attached to the box beam guardrail beam.

4 Claims, 10 Drawing Sheets

COMBINED GUARDRAIL AND CABLE SAFETY SYSTEMS

RELATED APPLICATIONS

This application is a divisional of co-pending U.S. patent application Ser. No. 12/113,514 filed May 1, 2008; which claims the benefit of U.S. provisional patent application No. 60/915,354 filed May 1, 2007. The contents of which are incorporated herein in its entirety by this reference.

TECHNICAL FIELD

The present disclosure is related to highway barriers and safety systems and more particularly to combined guardrail and cable safety systems and associated posts.

BACKGROUND OF THE DISCLOSURE

Guardrails are traffic barriers placed along roadsides to screen errant vehicles from hazards behind the barrier. A common guardrail in the U.S. is constructed using a standard steel W-beam or three-beam mounted on spaced wood or steel posts. Alternative guardrail installation designs incorporate a box beam rail member wherein the rail member may be a tubular beam member having a square or rectangular cross-section. Box beam guardrails are often popular in geographical locations that receive significant amounts of snow, as the use of box beam guardrails permits wider support post spacing and greater ground clearance as compared to W-beam and three-beam rail systems, and thus may reduce snow drift problems.

Another type of highway safety device is cable safety systems and cable barriers, which have been installed along edges of roadways and highways for many years. Cable safety systems and cable barriers have also been installed along medians between roadways and/or highways. Cable safety systems generally include one or more horizontal cables attached to support posts. For some applications cable safety systems and cable barriers may reduce damage to an impacting vehicle and/or injury to occupants of the impacting vehicle as compared with other types of highway safety systems and highway barriers.

Cable safety systems are often designed and installed with at least one cable mounted horizontally on a plurality of generally vertical support posts. The number of cables may vary depending on various factors such as the type of vehicles using the associated roadway and the hazard which required installation of the cable safety system. The length of a cable safety system is generally determined based on the adjacent roadside hazard. Each cable is typically installed at a selected height relative to the ground and with selected vertical spacing between adjacent cables. Associated support posts are installed with desired horizontal spacing between adjacent posts.

One recognized limitation of many cable safety systems is excessive deflection of associated cables during a vehicle impact. Deflection associated with a cable safety system may be larger than deflection of a conventional guardrail when subjected to the same type of vehicle impact. Such deflection frequently determines maximum allowed spacing between adjacent posts for satisfactory performance of the cable safety system. Large deflection during a vehicle impact also increases the risk of the vehicle running over the cables and being exposed to the hazard that required installation of the cable safety system. Calculating performance of many cable safety systems is often difficult due to unpredictable interactions between associated posts and cables during a vehicle impact. Depending upon car type, speed and angle of impact, cables may release as far as ten (10) or most posts spaced ahead of the impact location. Cable release from posts often causes much larger deflections than expected or calculated.

From full scale crash testing and from real life experience, it has been determined that keeping the length of unsupported cables as short as possible will generally reduce deflection. The longer the distance between adjacent posts supporting associated cables, the larger the deflection will generally be during a vehicle impact. An increased number of posts (shorter post spacing) will generally decrease deflection. However, shorter spacing between posts affects total cost of a cable safety system, not only material, but also installation cost.

During the past several years, cable safety systems have been used as an alternative to traditional guardrail systems. These cable safety systems address some of the weaknesses of prior cable safety systems by using pre-stretched cables and/or reducing spacing between adjacent posts to reduce deflection to an acceptable level. A consultant report "Dynamic Analysis of Cable Guardrail" issued in April 1994 by an ES-Consult in Denmark, established a model for various parameters, which affect performance and design considerations for acceptable deflection of cable safety systems.

Standards have been developed within the European standardization body, CEN (Commite Europeen de Normalisation), for impact tests performed on safety systems and barriers. These barrier impact tests are described in CEN 1317, Road Restraint Systems. According to the CEN standards, safety systems and barriers are to be impact tested at different containment levels. The elongation or deformation of a barrier is also measured to determine a safe working width. The environment in which the barrier is to be constructed generally determines appropriate containment level as well as permissible working width. The CEN standard generally requires that the risk of injury in a collision with the barrier is minimized (injury risk class). CEN standards are used in the European countries and several countries near Europe, among others.

NCHRP stands for the National Cooperative Highway Research Program, a program developed by the Transportation Research Board of the National Research Council, USA. Report 350 is entitled "Recommended Procedures for the Safety Performance Evaluation of Highway Features" and may be commonly referred to as the NCHRP 350 Standard. The standard describes how impact tests should be conducted. Test results may be used to determine elongation or deformation and safe working widths. This standard is used mainly in the USA and is predominately used in Australia and New Zealand.

SUMMARY OF THE DISCLOSURE

In accordance with teachings of the present disclosure, a combined guardrail and cable safety system is provided which may overcome many disadvantages and problems associated with prior guardrail safety systems, cable safety systems and cable barriers.

According to one embodiment of the present disclosure, a safety barrier incorporating the teachings of the present disclosure may include a plurality of cable posts spaced from each other and disposed adjacent to a roadway. At least two cables may be releasably engaged with and supported by the cable posts. The cable posts and the at least two cables may cooperate with each other to prevent a vehicle from leaving the roadway. A plurality of guardrail posts may also spaced from each other and disposed adjacent to the roadway longitudinally spaced from the plurality of cable post. A box beam guardrail beam may be attached to the plurality of guardrail posts. The at least two cables may operably extend from the cable posts to engage respective cable anchor brackets attached to the box beam guardrail beam.

According to another embodiment of the present disclosure, a method of forming a combined guardrail and cable safety system is provided. At least one cable from a cable safety system set along a roadway may be extended. The at least one cable may be operable to engage a portion of a guardrail safety system. A first end of the at least one cable may be secured with a cable anchor bracket coupled to a box beam rail that forms part of the guardrail safety system.

According to a further embodiment of the present disclosure, a combined guardrail and cable safety system may include a guardrail safety system extending along a roadway, the guardrail safety system having a plurality of guardrail posts. Each guardrail post may be operably coupled to a box beam guardrail beam. The system may also include at least one cable extending from a cable safety system and at least one cable anchor bracket fastened to a portion of the guardrail safety system. The at least one cable anchor bracket may be operable to receive and secure the at least one cable such that sufficient tension is applied to the respective cable.

According to yet another embodiment of the present disclosure, a safety barrier may include a plurality of cable posts spaced from each other and disposed adjacent to a roadway. Three cables may be releasably engaged with and supported by the cable posts. The cable posts and the cables may cooperate with each other to prevent a vehicle from leaving the roadway. The safety barrier may also include a plurality of guardrail posts spaced from each other and disposed adjacent to the roadway. The plurality of guardrail posts may be spaced from the plurality of cable posts. A plurality of box beam guardrail beams may be coupled to the plurality of guardrail posts. The guardrail posts and the box beam guardrail beams may cooperate with each other to prevent a vehicle from leaving the roadway. The first end of each cable may engage with a respective cable anchor bracket attached to a portion of the safety barrier system.

According to yet another embodiment of the present disclosure, a cable anchor bracket for use in a safety barrier system may include an elongated member having an inward side and an outward side. A first flange and a second flange each may be formed substantially perpendicular to and on the inward side of the elongated member. The elongated member, the first flange, and the second flange may be sized and configured to be attached to a box beam guardrail beam.

Technical benefits of the present disclosure include providing a combined box beam guardrail and cable safety system that maintains adequate barrier protection during a transition between cable and box beam guardrail safety systems. Because the cables may be coupled directly to associated guardrail beams, the cable may have adequate tension adjacent to the junction between the cable system and the guardrail system. Additionally, attaching the cables directly to the beams may transfer forces from an impacting vehicle to both the cable safety system and the guardrail safety system.

Additional technical benefits of the present disclosure include a combined guardrail and cable safety system that has cables with less tension and greater spacing between associated support posts. Due to the transition between the cable safety system and the box beam guardrail safety system, the combined guardrail and cable safety system maintains satisfactory deflecting characteristics.

Further technical benefits of the present disclosure include an economical design and the employment of component parts. Repairs or replacement of damaged components may often be more easily accomplished after a vehicle impact due to each component's design. The need for periodic re-tensioning of cables may be reduced or eliminated by the present disclosure.

Further technical benefits of the present disclosure include a flexible transition junction between a box beam guardrail safety system and cable safety system. Because cables extending from the cable safety system may be attached with associated guardrail beams, a smoother transition is possible from the cable the system to the guardrail safety system. Thus, designers have more flexibility in design and installation of cable and/or guardrail safety systems as determined by specific highway and roadway conditions.

The present disclosure allows differences in design and performance of cable and guardrail safety systems to be combined into an appropriate safety system for a wide variety of highways and roadways. The present disclosure provides a smooth transition between a box beam cable safety system and a guardrail safety system. The present disclosure provides a combination of guardrail and cable safety system designs which assists in joining or bridging the two safety systems.

All, some, or none of these technical advantages may be present in various embodiments of the present disclosure. Other technical advantages will be apparent to one skilled in the art from the following figures, descriptions, and claims.

BRIEF DESCRIPTION OF THE DRAWINGS

A more complete and thorough understanding of the present disclosure and advantages thereof may be acquired by referring to the following description taken in conjunction with the accompanying drawings, in which like reference numbers indicate like features, and wherein.

DETAILED DESCRIPTION OF THE DISCLOSURE

Preferred embodiments of the disclosure and its advantages are best understood by reference to FIGS. 1 through 14 wherein like reference numbers indicate like features.

The terms "safety system" or "safety systems" and "barrier" or "barriers" may be used throughout this disclosure to include any type of safety system and/or barrier which may be formed at least in part using cables, guardrails and support posts incorporating teachings of the present disclosure. The term "roadway" may be used throughout this disclosure to include any highway, roadway or path satisfactory for vehicle traffic. Safety systems and barriers incorporating teachings of the present disclosure may be installed in median strips or along shoulders of highways, roadways or any other path which is likely to encounter vehicular traffic. The term "upstream" may be used throughout this disclosure to refer to the direction from which an impacting vehicle would be expected to approach. The term "downstream" may be used throughout this disclosure to refer to the opposite direction, i.e., the direction toward which an impacting vehicle would be expected to travel.

Various aspects of the present disclosure will be described with respect to combined guardrail and cable safety systems 15. However, teachings of the present disclosure may be used to form a wide variety of safety systems and barriers.

Figure 1:
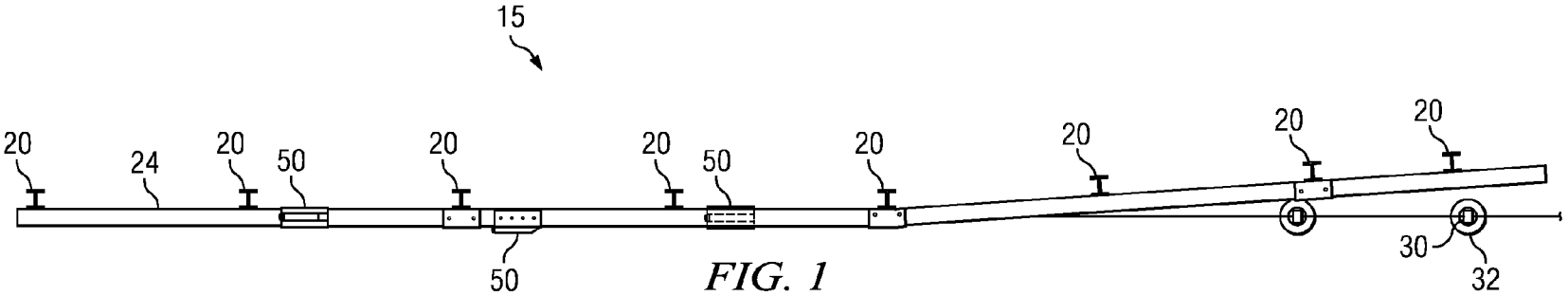
FIG. 1 illustrates a plan view of one embodiment of a combined guardrail and cable safety system incorporating teachings of the present disclosure.
Figure 2:
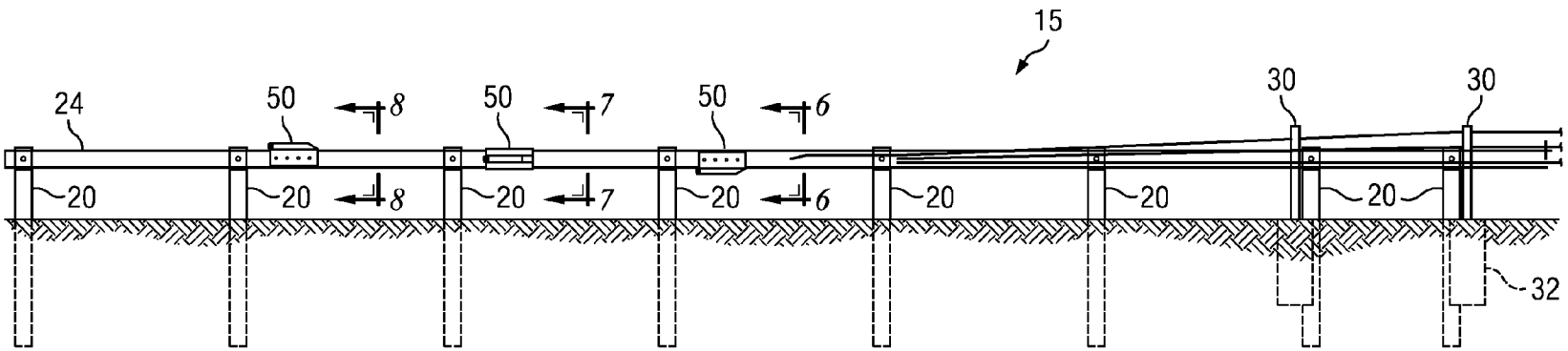
FIG. 2 illustrates an elevation view of the combined guardrail and cable safety system of FIG. 1.

Referring to FIGS. 1 and 2, combined guardrail and cable safety systems 15 may be installed adjacent to a roadway (not expressly shown) to prevent motor vehicles (not expressly shown) from leaving the roadway and to redirect vehicles away from hazardous areas without causing serious injuries to the vehicle's occupants or other motorists.

Combined guardrail and cable safety system 15 may be satisfactorily used as a median, a single barrier installation along the edge of a roadway and at merge applications between adjacent roadways. For some applications, combined guardrail and cable safety systems 15 may satisfactorily withstand a second impact before repairs have been made after a first impact. For many applications, combined guardrail and cable safety systems 15 may be described as generally maintenance free except for repairs required after a vehicle impact.

Combined guardrail and cable safety system 15 may include a plurality of support posts for cables, namely cable posts 30, and support posts for guardrail beams, namely posts 20, that are anchored adjacent to the roadway. Posts 20 and 30 may be anchored with the ground using various techniques. As shown in FIG. 1, concrete foundation 32 may be provided with holes to allow relatively quick and easy insertion and removal of cable posts 30. The number, size, shape and configuration of posts 20 and 30 may be significantly modified within teachings of the present disclosure. Optimum spacing between posts 20 and 30 may be designed in accordance with teachings of the present disclosure.

Figure 6:
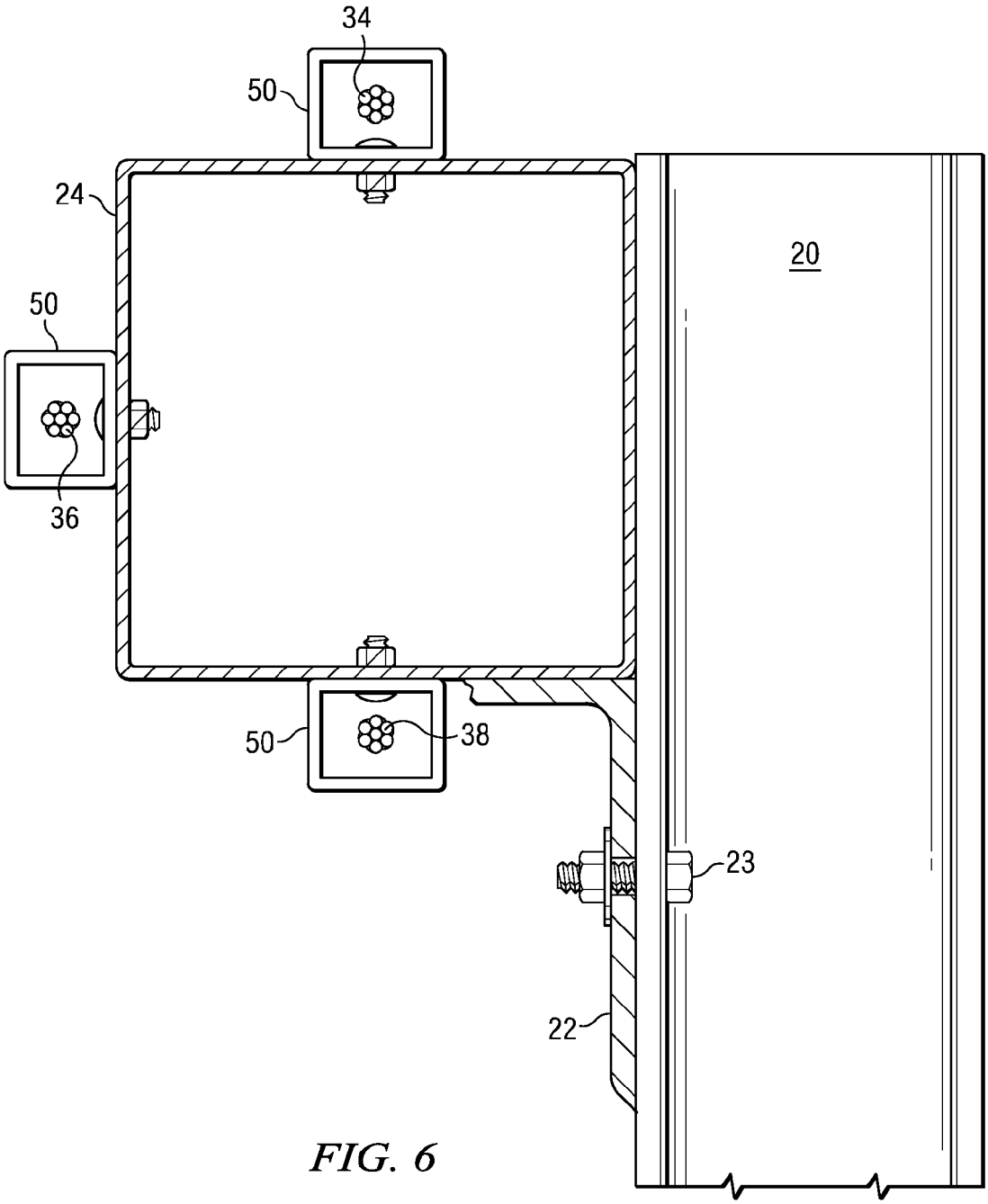
FIG. 6 is a schematic drawing taken along lines 6-6 of FIG. 2.

Guardrail beams 24 may be mounted on a plurality of posts 20 using bolt 23 and angle bracket 22 (as depicted in FIG. 6). Posts 20 may be made from wood, metal or other suitable types of material satisfactory for highway safety systems. The types of material which may be satisfactorily used to manufacture posts with the desired strength and/or breakaway characteristics appropriate for a specific guardrail system, location of each post and roadside hazard include, but are not limited to, wood, metal (e.g., steel), composite materials and other various types of plastics. In the depicted embodiments, posts 20 may comprise I-beam posts. Posts 20 may be connected to guardrail beam 24 adjacent to the roadway facing the oncoming traffic. Guardrail beams 24 may couple directly to posts 20 but may also include a block out structure (not expressly shown) disposed between post 20 and guardrail beam 24. When used, block outs may provide a lateral offset between a respective post 20 and guardrail beam 24 during a rail-face impact. The distance and direction of such lateral offsets may be selected to prevent the wheels (not shown) of a vehicle from striking one or more posts during a rail face impact.

In one particular application, posts 20 may be installed in foundation tubes (not shown). Other applications, for example in flared end terminals, two (2) posts 20 may be installed in the foundation tubes. The remaining posts may be installed adjacent to the highway without the use of any foundation tubes as such they are buried directly in the ground.

The total length of guardrail beam 24 measured from leading edge to trailing edge may be approximately twenty-five (25) feet. Other lengths of guardrail section including, but not limited to one-half lengths, or twelve and one-half foot members, may also be provided within teachings of the present disclosure. The overall geometry of guardrail beam 24 may allow combining guardrail beam 24 and conventional or standard box beam guardrails within a single guardrail system, to maintain the benefits described herein. Accordingly, guardrail beams 24 may be incorporated into existing guardrail systems as needed, and an entire retrofit of any particular guardrail system may not be required in order to recognize the benefits of the present disclosure. In fact, the overall geometry of guardrail beam 24 may be configured to accommodate a close fit between conventional or standard box beam guardrails.

Guardrail beam 24, formed in accordance with teachings of the present disclosure, provides improved safety performance and protection of the general public. Recently, increased interest in the need for more stringent safety requirements has culminated in the issuance of the National Cooperative Highway Research Program Report 350 (NCHRP 350). The performance standards of NCHRP 350 require all new safety hardware to be tested with larger vehicles than required by previous standards. NCHRP 350 evaluates all safety hardware within three areas: structural adequacy, occupant risk, and vehicle trajectory. Each area has corresponding evaluation criteria. The Federal Highway Administration (FHWA) officially adopted these new performance standards and has ruled that all safety hardware installed after August of 1998 will be required to meet the new standards.

Figure 3A:
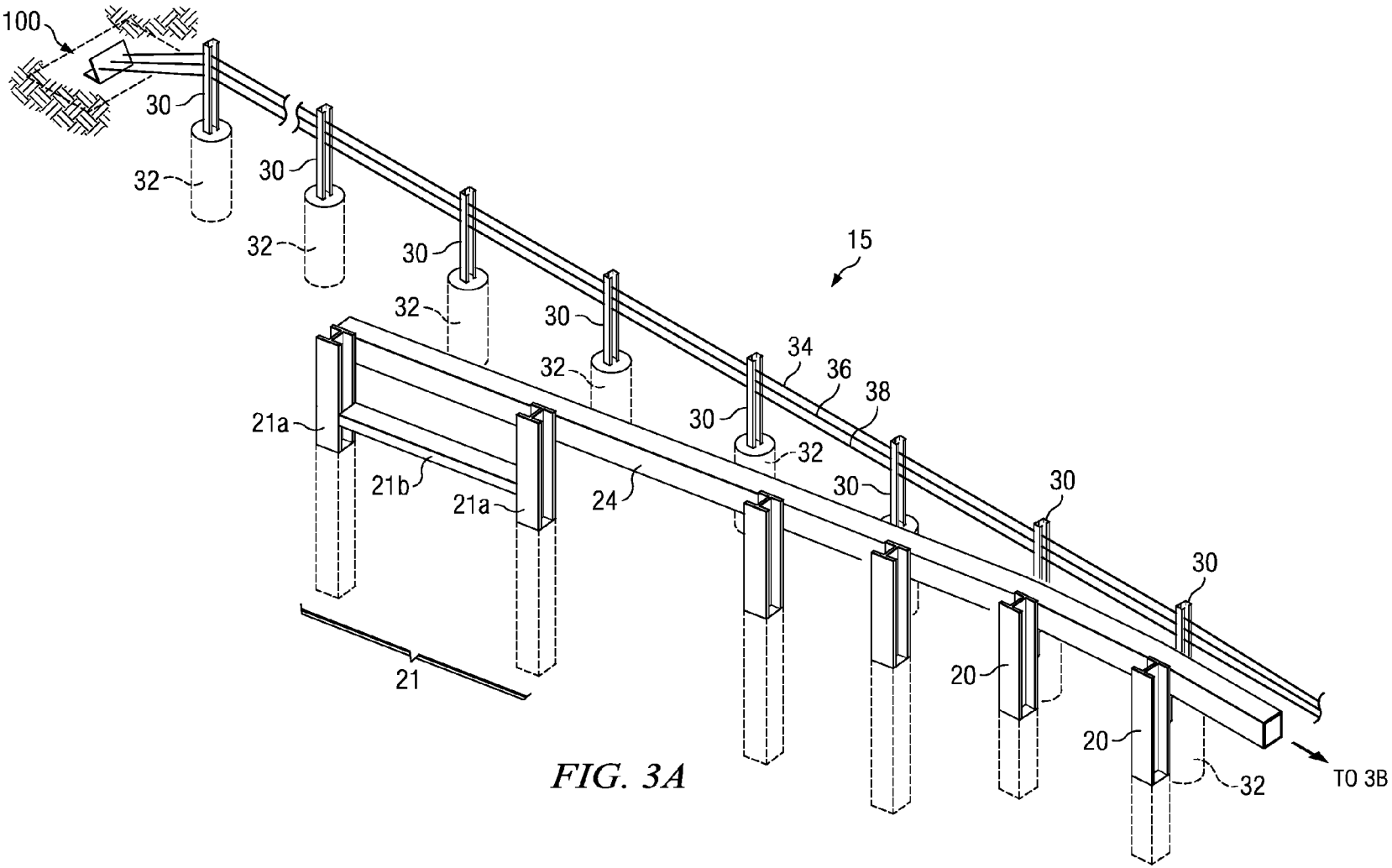
FIGS. 3A and 3B illustrate perspective views with portions broken away of one embodiment of a combined guardrail and cable safety system incorporating teachings of the present disclosure.
Figure 3B:
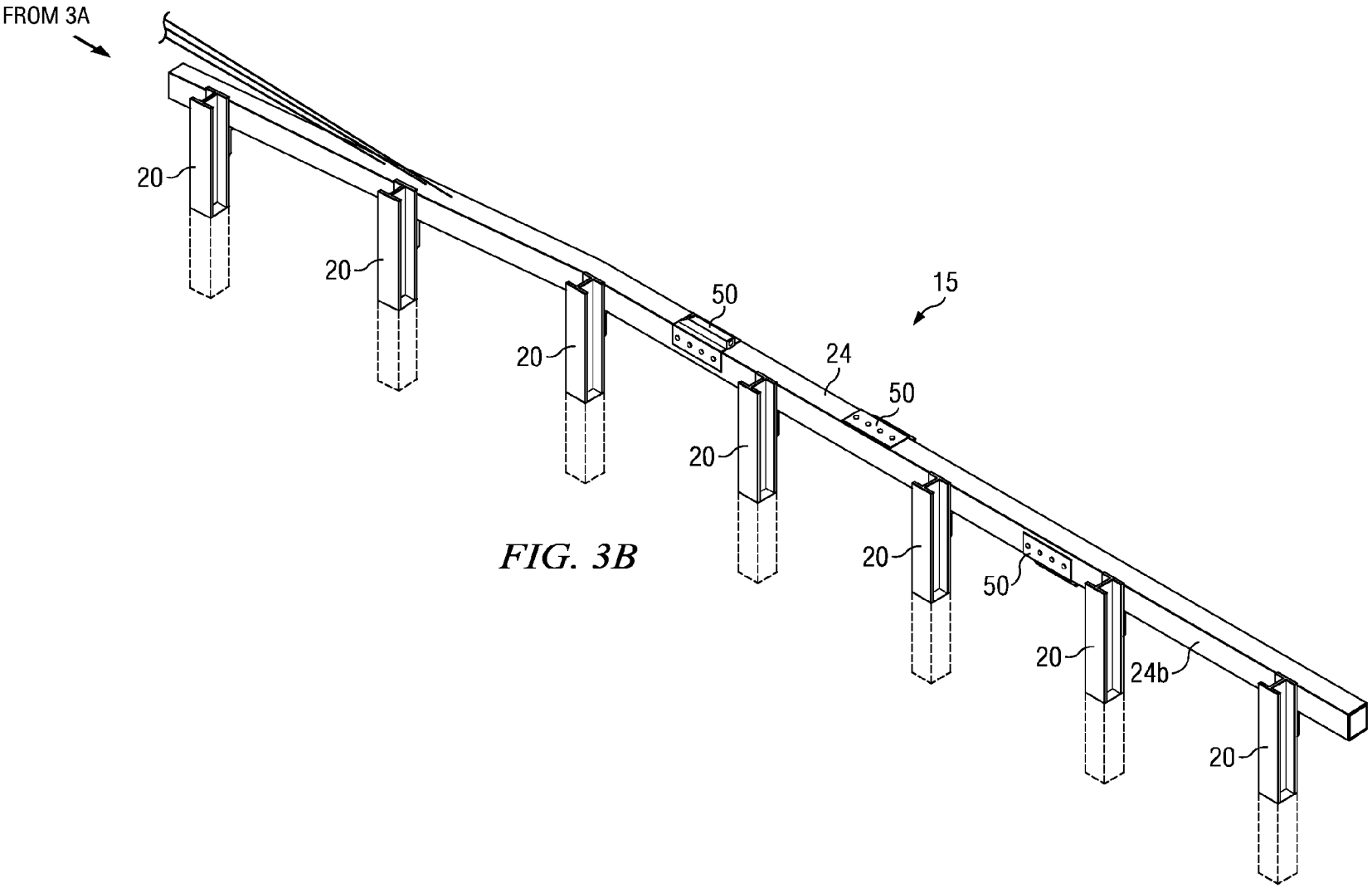

Various types of guardrail beams, cables and/or wire ropes may be satisfactorily used to form a combined guardrail and cable safety system 15 in accordance with teachings of the present disclosure. Cables 34, 36 and 38, as shown in FIGS. 3A and 3B, may be substantially identical. However, for some applications each cable of safety system 15 formed in accordance with teachings of the present disclosure may have different characteristics. Cable safety systems may be described as flexible, substantially maintenance free systems with designed low deflection of cables 34, 36 and 38 during a vehicle impact. In some embodiments of the present disclosure, cable safety systems may minimize damage during a vehicle impact with posts 30 and/or cables 34, 36 and 38.

Guardrail end terminal assembly 21 may be provided to minimize or eliminate the potential for a serious accident from a head on collision with the end of guardrail safety system facing oncoming traffic. As such, the present disclosure may be used with either energy absorbing end terminals or non-energy absorbing end terminals. In some embodiments, guardrail end terminal assembly 21 may include kinetic energy absorbing assembly (not expressly shown) which may prevent guardrail safety system from piercing the vehicle and passenger compartment or causing a vehicle to either roll over or vault the guardrail safety system. In the event of a collision between a vehicle and the end of the guardrail safety system, a kinetic energy absorbing assembly may dissipate the impact energy of the vehicle without creating an unduly dangerous condition.

Guardrail end terminal assembly 21 may include post 21 connected by cross member 21*b*. Post 21*a* and cross member 21*b* may be made from wood or other suitable types of breakaway material. The types of material which may be satisfactorily used to manufacture posts with desired strength and/or breakaway characteristics appropriate for the specific guardrail system, location of each post and roadside hazard include but are not limited to wood, steel, composite materials and various types of plastics.

Various guardrail designs and end terminal assemblies have been developed to minimize consequences resulting from impact between a vehicle and the end of a guardrail. These designs include tapering the end of the guardrail into the ground to eliminate potential contact with the end of the guardrail. Other types of end terminal assemblies include breakaway cable terminals (BCT), slotted rail terminals (SRT), sequential kinking terminals (SKT), vehicle attenuating terminals (VAT), end terminal assemblies (ET), flared end terminals (FET) including flared energy absorbing terminals (FLEAT), the Sentre end treatment, and breakaway end terminals (BET).

It is desirable for guardrail end terminal assembly 21 to be usable at either end of a guardrail as a means of both attenuating a head on impact as well as providing an effective anchor for an impact along the side of the guardrail downstream from the end terminal assembly. Examples of such end terminal assemblies are shown in U.S. Pat. No. 5,391,016 entitled "Metal Beam Rail Terminal", and U.S. Pat. No. 7,185,882 entitled "Box Beam Terminals".

Figure 4A:
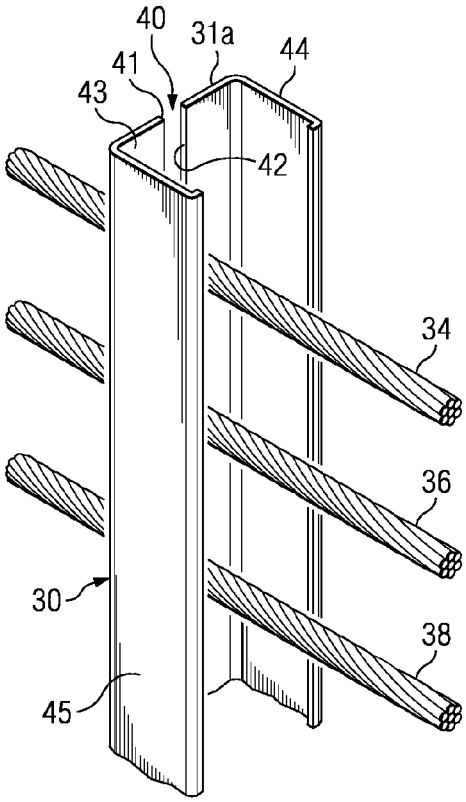
FIG. 4A is an enlarged schematic drawing showing an isometric view with portions broken away of a post and cables satisfactory for use with a combined guardrail and cable safety system incorporating teachings of the present disclosure.

FIG. 4A is an enlarged schematic drawing showing an isometric view with portions broken away of cable post 30 and cables 34, 36 and 38 incorporating teachings of the present disclosure. As shown in this embodiment of the present disclosure, cable post 30 may include a generally C-shaped cross section defined in part by web 43 with respective legs 44 and 45 extending therefrom.

Typically, the extreme edges of each leg 44 and 45 opposite from attached web 43 may be rounded or bent inward to eliminate any sharp edges being exposed. Cable post 30 may have a "rounded" or "soft" profile. For some applications, cable post 30 may be formed using roll forming techniques.

Slot 40 may be formed in web 43 extending from first end 31*a* towards second end 31*b* (as shown below in more detail). The length of slot 40 may be selected in part based on desired vertical spacing of cable 38 relative to the adjacent roadway. The length of slot 40 may also be selected to accommodate the number of cables which may be installed therein and desired vertical spacing between each cable. Slot 40 may have a generally elongated U-shaped configuration defined in part by first edge 41, second edge 42 and bottom 47 (shown below in more detail). In some embodiments, first edge 41 and second edge 42 may have a generally smooth profile and extend generally parallel with each other. Forming slot 40 within web 43 of cable post 30 may eliminate requirements for bolts, hooks or other mechanical attachments to releasably secure cables 34, 36 and 38 with cable post 30.

For some applications, cable post 30 may be formed from metal sheet having a thickness of 4 millimeters, a length varying approximately from 700 millimeters to 1,600 millimeters and a width of approximately 350 millimeters. The metal sheet may weigh approximately 7.8 kilograms per meter (kg/m). For other applications, cable post 30 may be formed from a metal sheet having a thickness of 4 millimeters, a length varying approximately from 700 millimeters to 1,600 millimeters, a width of approximately 310 millimeters and a weight of less than 4.5 kg/m.

In some aspects, cable post 30 may be installed in a tube sleeve (not expressly shown) that is driven directly into the soil.

Figure 4B:
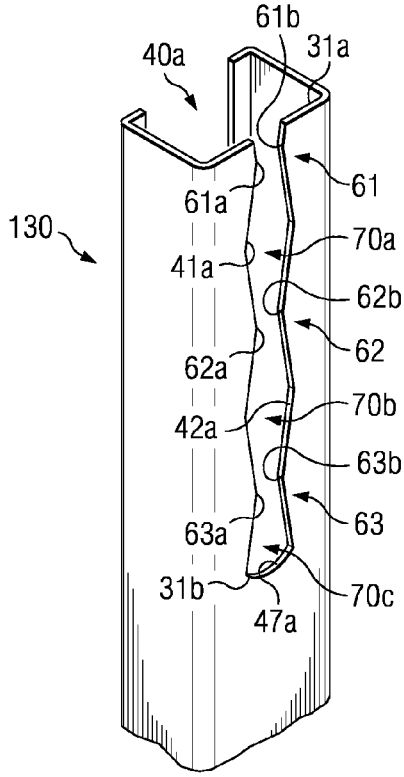
FIG. 4B is a schematic drawing in elevation with portions broken away showing another example of a cable post formed in accordance with teachings of the present disclosure.

One aspect of the present disclosure includes forming one or more restrictions within slot 40 to help retain associated cables within the respective slot when a vehicle impacts the associated safety barrier. Cable post 130 as shown in FIG. 4B may retain cables 34, 36 and 38 within slot 40*a* by restrictions formed along edges 41*a* and 42*a*. As a result of the restrictions formed within slot 40*a*, cables 34, 36 and 38 may be retained within slot 40*a* when cable post 130 impacted by a vehicle and is bent at an angle from vertical, which typically causes the release of cable 34, 36 and 38 from slot 40 of cable post 30.

FIG. 4B is an enlarged schematic drawing showing another example of cable post 130 having slot 40*a* form thereon with a plurality of restrictions and/or projections formed in each edge 41*a* and 42*a*. For the embodiment of the present disclosure as shown in FIG. 4B the location and configurations of the restrictions formed in edges 41*a* and 42*a* may be selected to correspond generally with the desired location for associated cables 34, 36 and 38.

Restrictions 61, 62 and 63 of slot 40*a* may be defined in part by respective projections 61*a*, 61*b*, 62*a*, 62*b*, 63*a*, 63*b* and bottom 47*a*. Edges 41*a* and 42*a* of slot 40*a* may include alternating tapered or sloping surfaces which form respective projections 61*a*, 61*b*; 62*a*, 62*b* and 63*a*, 63*b*. The same tapered or sloping surfaces also form respective enlarged openings 70*a*, 70*b* and 70*c* within slot 40*a*. The location of enlarged openings 70*a*, 70*b* and 70*c* may be selected to correspond with approximate desired locations for cables 34, 36 and 38. The gap or spacing formed between respective projections 61*a* and 61*b*, 62*a* and 62*b* and 63*a* and 63*b* is generally selected to be greater than the outside diameter of cables 34, 36 and 38.

Specific dimensions between the respective projections are selected to provide optimum resistance to disengagement between cables 34, 36 and 38 as cable post 130 with slot 40*a* is bent from a generally vertical position towards a horizontal position and still allow easy installation of cables 34, 36 and 38 in slot 40*a*.

Figure 5:
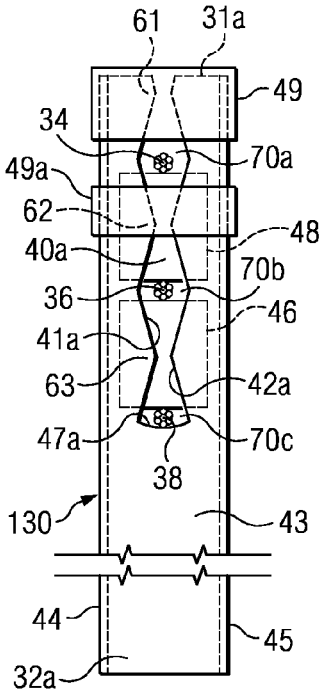
FIG. 5 is a schematic drawing in elevation with portions broken away showing another example of a post and attached cables satisfactory for use with a combined guardrail and cable safety system incorporating teachings of the present disclosure.

FIG. 5 is a schematic drawing in elevation with portions broken away showing one example of cable post 30 and attached cables 34, 36 and 38 incorporating teachings of the present disclosure. Respective cap 49 may be placed on first end 31 of each cable post 30. Retaining band or bands 49*a* may be placed on the exterior of one or more cable posts 30 to provide additional strength. Cap 49 and retaining bands 49*a* may be formed from various types of metals, elastomeric materials and/or composite materials.

For some applications, retaining band 49*a* may be formed from a relatively strong steel alloy to provide additional support to allow cable post 30 to handle forces imposed on edges 41 and 42 by cables 34, 36 and 38 during a vehicle impact with combined guardrail and cable safety system 15, cable 38 may be disposed within slot 40 resting on bottom 47 therein. Since cable post 30 has a partially closed cross section defined in part by the bend or rounded edges of legs 44 and 45, a relatively simple first spacer 46 may be inserted or dropped into cable post 30 to rest on cable 38 opposite bottom 47. Spacer 46 may be a block having a generally rectangular configuration with a thickness satisfactory for insertion within the cross section of cable post 30. The height of spacer 46 may be selected to correspond with desired vertical spacing between cables 38 and 36.

Cable 36 may be inserted into slot 40 after spacer 46 has been disposed onto cable 38. Spacer 48 may then be installed within slot 40 with one end resting on cable 36 opposite from the spacer 46. The height of spacer block 48 may be selected to correspond with desired vertical spacing between cables 36 and 34. Spacer 48 may be a block having a generally rectangular configuration with a thickness satisfactory for insertion within the cross section of cable post 30.

Cable 34 may then be installed within slot 40 resting on spacer 48 opposite from cable 36. One or more retaining bands 49*a* may be secured with the exterior of cable post 30 between cables 34 and 36 and/or cables 36 and 38. Cap 49 may be placed over first end 31 of cable post 30 after installation of cables 34, 36 and 38 and spacers 46 and 48.

For some applications, second end 32*a* of each cable post 30 may be installed in concrete foundation 32 or footing (not expressly shown). In other applications, a flip plate (not expressly shown) may be attached to second end 32*a* of each cable post 30 for use in bolting or otherwise securely attaching cable post 30 with a larger flip plate (not expressly shown) that has been cast into a concrete foundation or similar structure adjacent to a roadway. Alternatively, second end 32*a* may be inserted directly into the ground. One or more soil plates (not expressly shown) may be attached to cable post 30 proximate respective second ends 32*a* when cable post 30 are installed directly into the ground adjacent to a roadway.

In other embodiments of the present disclosure, cable safety system may be formed using a low-tensioned cable system such as cable systems including I-beam posts and hook bolts (not expressly shown).

FIG. 6 is a schematic drawing taken along lines 6-6 of FIG. 2. In one embodiment, post 20 may be coupled to and support guardrail beam 24 using bolt 23 and angle bracket 22. Cables 34, 36 and 38 may be run longitudinally with guardrail beam 24. As illustrated, cables 34, 36 and 38 may extend from cable safety system to run near one or more faces of guardrail beam 24. For example, cable 34 may run near the top of beam 24, cable 36 may run near the side of beam 24 facing traffic, and cable 38 may run near the bottom of beam 24. Also as depicted, cable anchor bracket assemblies 50, each configured to receive one of cables 34, 36 and 38, may be coupled to guardrail beam 24, as shown in greater detail in FIG. 9.

Figure 7:
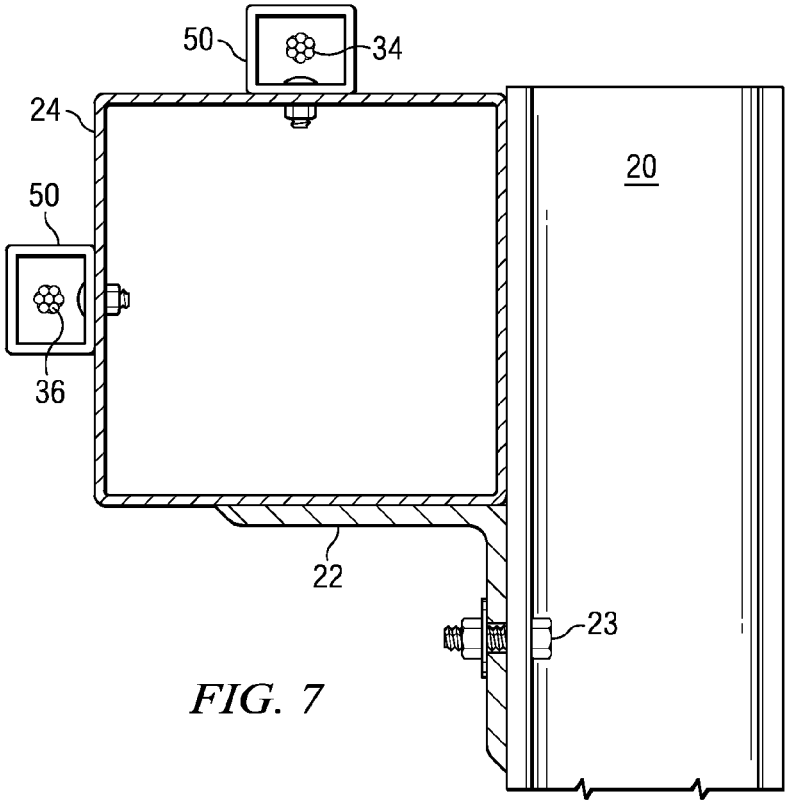
FIG. 7 is a schematic drawing taken along lines 7-7 of FIG. 2.

FIG. 7 is a schematic drawing taken along lines 7-7 of FIG. 2. Cables 34 and 36 are shown running longitudinally with guardrail beam 24. As illustrated, cable 38 is not shown, as it is coupled to a cable anchor bracket assembly 50 upstream of lines 7-7 of FIG. 2.

Figure 8:
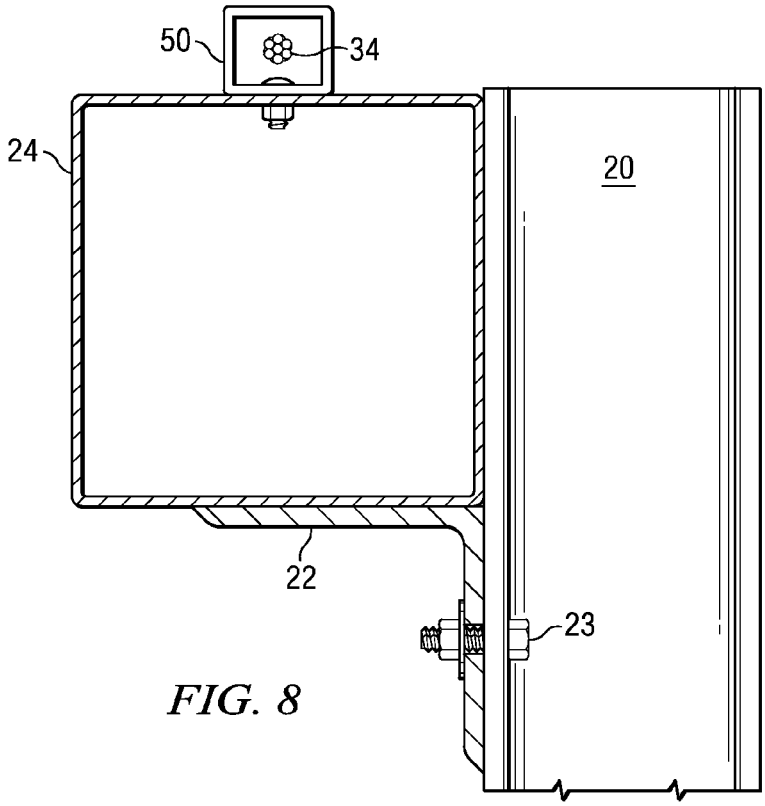
FIG. 8 is a schematic drawing taken along lines 8-8 of FIG. 2.

FIG. 8 is a schematic drawing taken along lines 8-8 of FIG. 2. As depicted, cables 34, 36 and 38 may be terminated into a cable anchor bracket assembly 50 at different locations along guardrail beam 24. For example, as illustrated in FIGS. 1, 2 and 3A and 3B, cables 34 and 36 may be attached along other sections of combined guardrail and cable safety system 15 such that cable 38 is the remaining cable to be coupled to guardrail beam 24 via a cable anchor bracket assembly 50, as shown in FIG. 8. Accordingly, cables 36 and 38 are not shown in FIG. 8, as they may be coupled to cable anchor bracket assemblies 50 upstream of lines 8-8 of FIG. 2.

As depicted in FIGS. 1, 2, 3B, 6, 7, and 8, brackets 50 may be attached to guardrail beam 24 such that each cable 34, 36, and 38 terminates adjacent to a different face of guardrail beam 24. For example, cable 34 may terminate adjacent to the top face of guardrail beam 24, cable 36 may terminate adjacent to the lateral face of guardrail beam 24 facing traffic, and cable 38 may terminate adjacent to the bottom face of guardrail beam 24.

Figure 9:
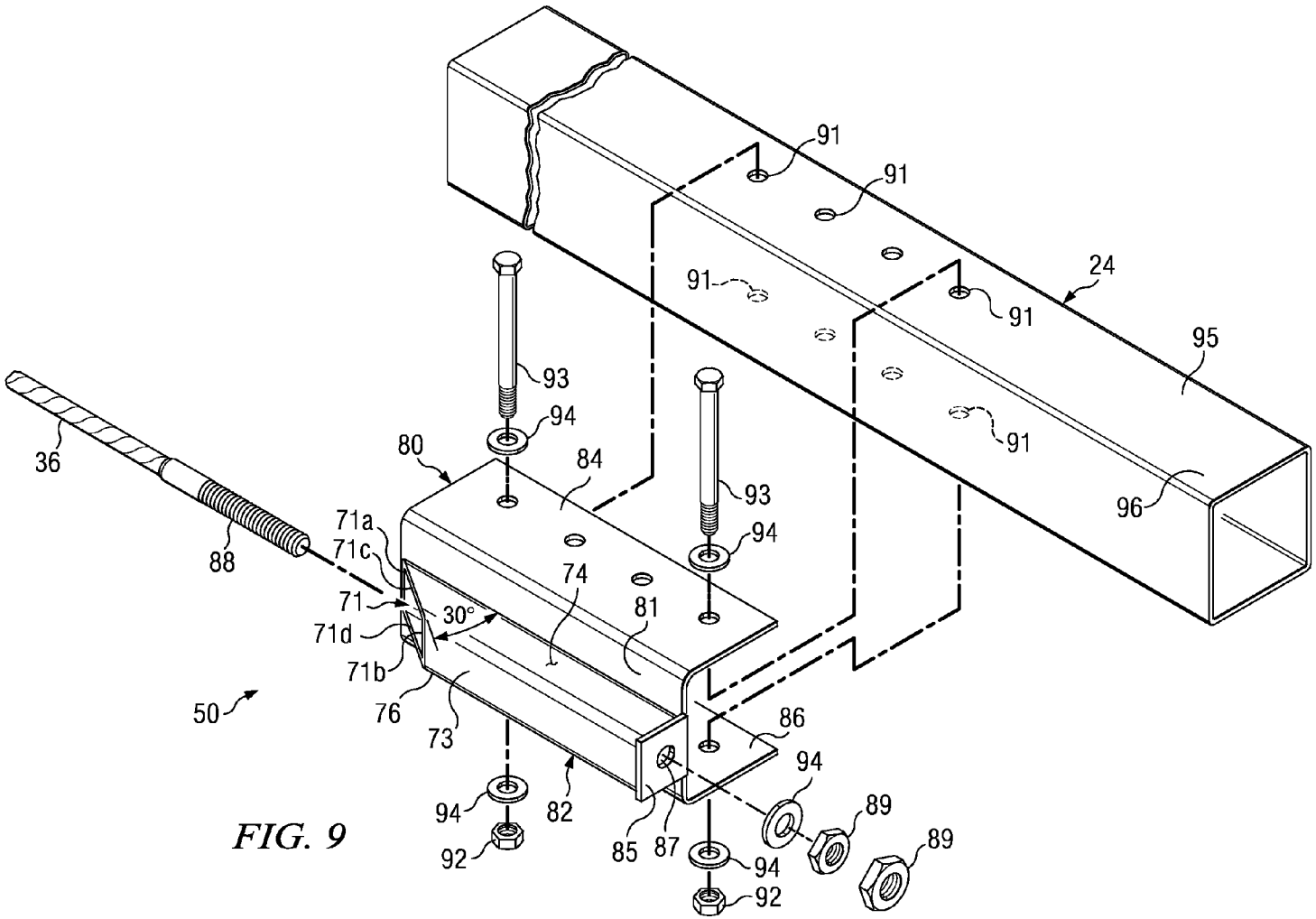
FIG. 9 is an enlarged schematic drawing with portions broken away showing an isometric view of an example embodiment of a combined guardrail and cable safety system with a cable anchor bracket incorporating teachings of the present disclosure.

FIG. 9 is an enlarged schematic drawing showing an isometric view of an example embodiment with portions broken away of combined guardrail and cable safety system 15 and cable anchor bracket assembly 50 incorporating teachings of the present disclosure. Cable anchor bracket assembly 50 may include cable anchor bracket 80 that is attached to the top, bottom or side face of guardrail beam 24.

Cable anchor bracket 80 may include elongated member 81 having a first flange 84 and a second flange 86. Each of first flange 84 and second flange 86 may be formed substantially perpendicular to elongated member 81, and may be configured to attached cable anchor bracket 80 to guardrail beam 24. Elongated member 81, first flange 84 and second flange 86 may cooperate with each other to define a generally U-shaped cross section sized to receive guardrail beam 24.

First flange 84 and second flange 86 may each include holes 91 and may be used to couple cable anchor bracket 80 to guardrail beam 24 via bolts 93 extending through guardrail beam 24 and secured with washers 94 and nuts 92. Bolts 93 and nuts 94 may be arranged longitudinally along guardrail beam 24 to mount and couple cable anchor bracket 80 thereto. Although the present embodiment is illustrated with two washers 94, the present disclosure may be practiced with more or less number of washers including but not limited to various types of washers such as a flat washer or a lock washer. In the some embodiments of the present disclosure, bolts 93 may be hex bolts. However, bolts 93 may include a variety of fastening devices such as carriage bolts, rivets, screws or any other type of connector.

Cable anchor bracket 80 may include cable receiving channel 82 coupled to elongated member 81. Cable receiving channel 82 may have a first channel member 74 and second channel member 76 formed adjacent and longitudinally to elongated member 81. First channel member 74 and second channel member 76 may be substantially parallel to each other and substantially perpendicular to elongated member 81. Cable channel 82 may also include third channel member 73 formed adjacent and longitudinally to each of first channel member 74 and second channel member 76. Cable channel 82 may also include plate 85 formed perpendicular to each of first channel member 74, second channel member 76, and third channel member 73. Plate 85 may be configured to engage cable 34, 36 or 38. As depicted, first channel member 74, second channel member 76, third channel member 73, plate 85, and elongated member 81 may cooperate with each other to form cable channel 82 with openings 71 and 87. In certain embodiments, cable channel 82 may have a generally square- or rectangular-shaped cross section.

As illustrated, an end of cable 36 may inserted through bracket channel 82 formed in cable anchor bracket 80 for attachment to cable anchor bracket assembly 50. The end of cable 36 may extend into opening 71 of cable anchor bracket 80 that is mounted onto guardrail beam 24 and may feed through opening 87 of plate 85 for attachment to cable anchor bracket 80. Threaded cable termination 88 may be provided on an end portion of cable 36 to allow for connection to cable anchor bracket assembly 50. Once extended through opening 87, a washer 94 and nuts 89 may be used in conjunction with threaded cable termination 88 and plate 85 to fasten cable 36 to cable anchor bracket 80. In some embodiments, cable tension of cable 38 may be adjusted by turning nuts 89 against washer 94 adjacent to plate 85. Cable anchor bracket assembly 50 and the respective attachments and cables of the present disclosure may meet National Highway Safety requirements and allow reducing the manufacturing costs of the associated connections and mountings as compared with other end terminal assemblies.

As shown in FIG. 9, in some embodiments opening 71 may be angled such that edge 71*b* formed by third side 73 may be located downstream relative to edge 71*a* formed by elongated member 81, and the edges 71*c* and 71*d* of opening 71 formed by each of first side 74 and second side 76 may be appropriately tapered or angled from edge 71*a* to edge 71*b*. In certain embodiments, the angle formed by an imaginary line substantially parallel to elongated member 81 and each of edge 71*c* and 71*d* may be approximately 30 degrees. This manner of angling opening 71 in a downstream manner may reduce the likelihood of an impacting vehicle snagging or catching on cable anchor bracket 50, thus potentially reducing damage to the impacting vehicle or injury to the occupants thereof.

Figure 10A:
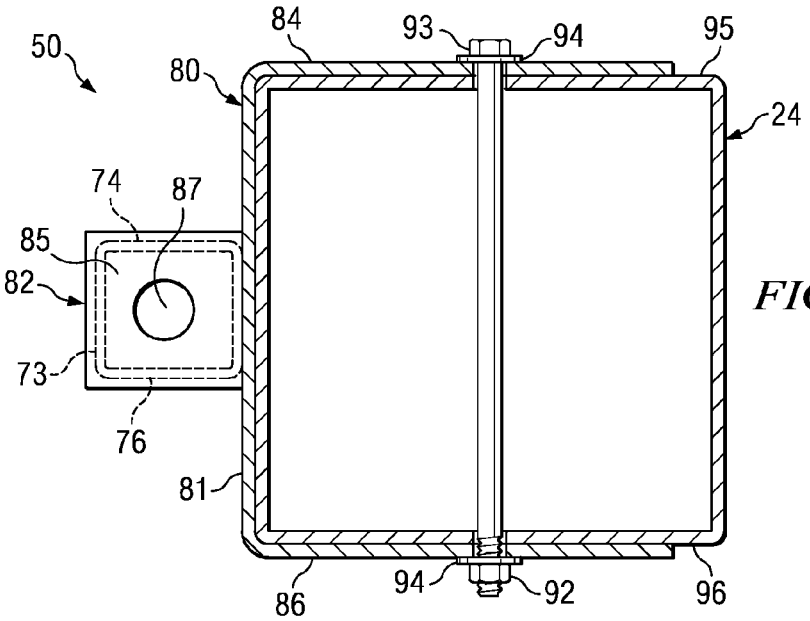
FIGS. 10A and 10B are schematic drawings in section of a cable anchor bracket incorporating teachings of the present disclosure bolted to a box beam.
Figure 10B:
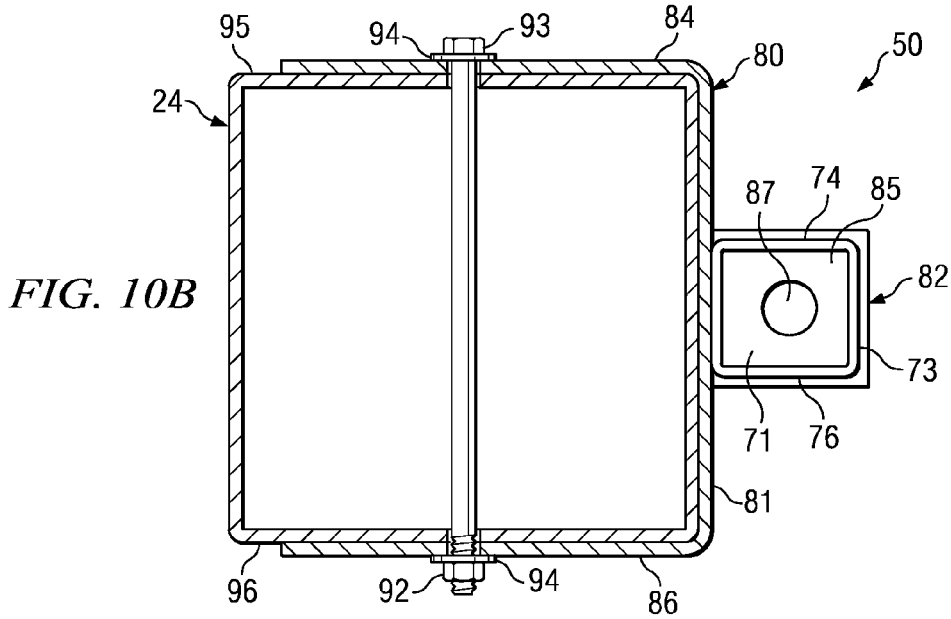

FIG. 10A illustrates a cross-sectional upstream view of the cable anchor bracket 80 bolted to a guardrail beam 24 incorporating teachings of the present disclosure. FIG. 10B illustrates a cross-sectional downstream view of the cable anchor bracket 80 bolted to a guardrail beam 24 incorporating teachings of the present disclosure. In some embodiments, cable anchor bracket 80 may form a generally rectangular cross-section to allow for the insertion of end of cable 34, 36 and 38 having a end terminal connections such as threaded cable termination 88 mounted on the end of the cable for attaching the cable to the assembly.

As shown, first flange 84 may extend along the same direction and same angle as a first face 95 of guardrail beam 24 to allow bolts 93 to extend therethrough and couple using nut 92 and washer 94. Similarly, second flange 86 may extend along the same angle as a second face 96 of guardrail beam 24 for coupling using bolt 93 with washers 94 and nut 92. In some embodiments, first face 95 and second face 96 may be substantially parallel to each other. Depending on design criteria, cable anchor bracket 80 may include more or less mounting bolt connections.

Figure 11:
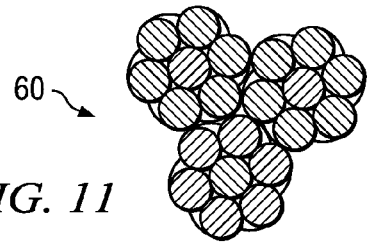
FIG. 11 is a schematic drawing in section showing one example of a cable satisfactory for use in forming a cable safety system.

FIG. 11 is a schematic drawing in section showing one example of a cable 60 satisfactory for use in forming a cable safety system in accordance with teachings of the present disclosure. For some applications cables 34, 36 and 38 may be formed from seven strand wire rope. Other types of wire ropes and cables may also be used. A plurality of cables 34, 36 and 38 may be attached to support posts 30 in accordance with teachings of the present disclosure. Support posts 30 may maintain associated cables 34, 36 and 38 in substantially horizontal positions extending along an edge of the roadway. Support posts 30 may allow relative quick and easy repair of combined guardrail and cable safety systems 15 after a vehicle impact.

Cable safety systems may be relatively narrow as compared to conventional W-beam, three beam, and box beam guardrail systems. The length of cables 34, 36 and 38 may extend up to 3,000 meters from below-ground anchor 100. For other applications the length of cable 34, 36 and 38 may exceed 3,000 meters without an intermediate anchorage. Cable posts 30 may maintain desired vertical spacing between cables 34, 36 and 38 and desired vertical spacing of each cable relative to the ground. Cable safety system including cable posts 30 formed in accordance with teachings of the present disclosure may be designed in accordance with teachings of the present disclosure to meet or exceed the criteria of NCHRP Report 350 Test Level 3 requirements.

Cables 34, 36 and 38 may be disposed in slot 40 of each cable post 30. Each cable 34, 36 and 38 may be disposed at different heights relative to the ground and relative to each other. Varying the vertical spacing between cables 34, 36 and 38 may provide a much wider lateral catch area for vehicles impacting with combined guardrail and cable safety system 15. The vertical spacing between cables 34, 36 and 38 may be selected to satisfactorily contain both pickup trucks and, to some extent, even larger vehicles with a relatively high center of gravity, as well as vehicles with a low front profile and low center of gravity.

Cables 34, 36 and 38 may be prefabricated in approximately three hundred (300) meter lengths with desired fittings attached with opposite ends of each cables 34, 36 and 38. Tailor made cables 34, 36 and 38 may then be delivered to a desired location for installation adjacent to a roadway.

Alternatively, cables 34, 36 and 38 may be formed from a single cable stored on a large drum (not expressly shown). Cables stored on drums may often exceed three thousand (3,000) meters in length. Cables 34, 36 and 38 may be cut in desired lengths from the cable stored on the drum. Appropriate fittings (not expressly shown) may be swaged or otherwise attached with opposite ends of the respective cable 34, 36 and 38 at an onsite location. In one embodiment, cables 34, 36 and 38 may be installed between below ground anchors 100 and cable anchor bracket assembly 50 with approximately twenty thousand Newtons of tension over a length of approximately three thousand (3,000) meters.

Cable 60 as shown in FIG. 11 may be formed from three groups of seven strand wire rope. Cable 60 may be used in forming combined guardrail and cable safety system 15. Cable 60 may have a modulus of elasticity of approximately 8,300 kilograms (kg) per square millimeter (mm). The diameter of each strand used to form cable 60 may be approximately three (3) mm. The diameter of cable 60 may be approximately nineteen (19) mm. Cable 60 may be pre-stretched to approximately fifty percent (50%) of designed or rated breaking strength. One or more cables 60 may be used to replace cables 34, 36, and/or 38 of combined guardrail and cable safety system 15.

Figure 12:
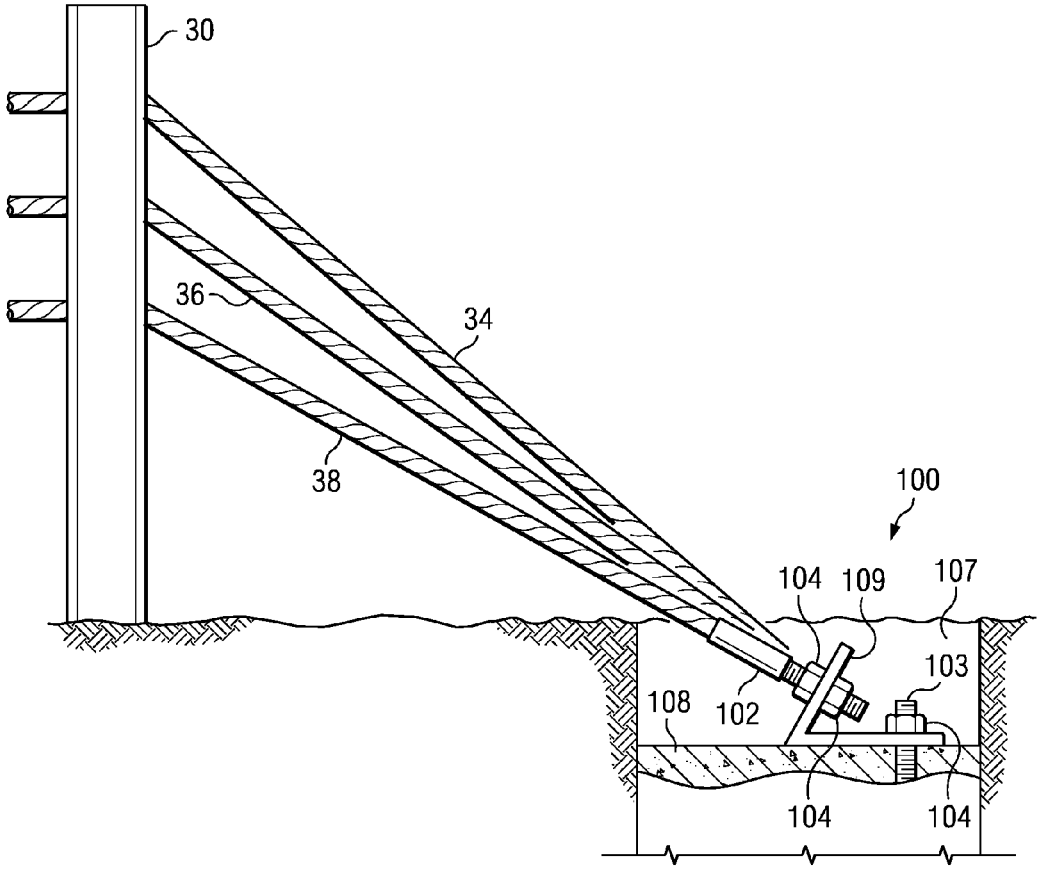
FIG. 12 is a schematic drawing in section and in elevation with portions broken away of a below-ground cable anchor assembly satisfactory for use with the cable safety system of FIG. 3A.

FIG. 12 shows one example of below-ground anchor 100 which may be satisfactorily used with a combined guardrail and cable safety system 15 incorporating teachings of the present disclosure. Below-ground anchor 100 may be set approximately ten feet from cable post 30. Respective holes 107 may be formed in the ground at desired locations for below-ground anchor 100. A portion of each hole 107 may be filled with concrete foundation 108.

Anchor plate 109 may be securely engaged with concrete foundation 108 using various types of mechanical fasteners, including, but not limited to, a plurality of bolts, such as concrete anchor bolts 103, and nuts 104. Anchor plate 109 may be formed at an appropriate angle to accommodate the design of combined guardrail and cable safety system 15. Also multiple slots and/or openings (not expressly shown) may be formed in anchor plate 109 to receive respective threaded cable termination 102 extending from each cable 34, 36 and 38.

For the embodiment of the present disclosure as shown in FIG. 12, threaded cable termination 102 of cable 32 may be engaged with anchor plate 109. Threaded cable termination 102 may use nuts 104 to coupled on both sides of anchor plate 109 to maintain a fixed position in relation to anchor plate 109. Various types of anchor assemblies and cable end fittings such as threaded cable termination 102 may be satisfactorily used with a combined guardrail and cable safety system incorporating teachings of the present disclosure. The present disclosure is not limited to below-ground anchor 100 or threaded cable termination 102 as shown in FIG. 12.

Figure 13:
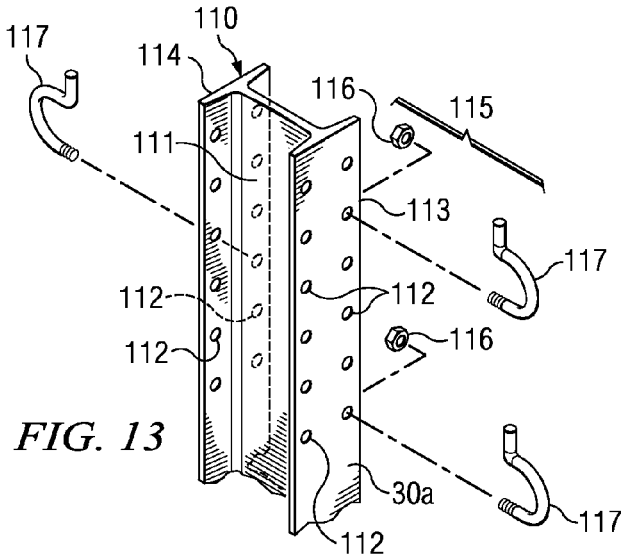
FIG. 13 is an enlarged schematic drawing showing an isometric view with portions broken away of one embodiment of a cable post satisfactory for use with a combined guardrail and cable safety system incorporating teachings of the present disclosure.

FIG. 13 is an enlarged schematic drawing showing an isometric view with portions broken away of one embodiment of cable post 30*a* satisfactory for use with a combined guardrail and cable safety system incorporating teachings of the present disclosure. Cable posts 30*a* may be interchangeable with cable posts 30. Cable posts 30*a* may be associated with various types of mounting structures such as a foundation tube such as concrete tube 32 or a soil plate (not expressly shown) for direct placement in the ground.

As shown in FIG. 13, cable post 30*a* may include a generally I-beam cross section defined in part by web 111. Connecting flanges 113 and 114 are formed on opposite ends of web 111 such that flanges 113 and 114 generally extend perpendicular to web 111. Typically, flanges 113 and 114 are arranged substantially parallel to each other allowing cables 34, 36 and 38 to couple to flanges 113 and/or 114 at respective heights from the ground level. As such, flanges 113 and 114 may be mounted and/or installed parallel to a highway or roadway (not expressly shown).

In order to maintain or alter the position of cables 34, 36 and 38, with respect to ground level, cable post 30*a* may further include cable retainers 115. Each cable retainer 115 may be associated with a respective cable 34, 36 and 38 to maintain its position relative to ground level on cable post 30*a*. Cable retainers 115 may include a variety of attachment retainers such as u-bolt clamps, cable clamps or other mechanical devices that may retain cable 34, 36 or 38 to cable post 30*a*. In one embodiment, cable retainer 115 includes cable lock bolt 117 and nut 116 that fasten respective cables 34, 36 and 38 at associated openings 112.

Openings 112 are typically formed in cable post 30*a* along the edges of flanges 113 and 114. As shown in the embodiment, two openings 112 are formed to receive respective ends of cable lock bolt 117 such that nut 116 attaches to at least one end of cable lock bolt 117 to couple one of cables 34, 36 or 38 to cable post 30*a*. Openings 112 are generally formed in columnar groups such that cable height may be varied based on the selection of different openings 112.

For example, six openings 112 may be formed in a substantially columnar group extending from top 110 of cable post 30*a* toward ground level along one edge of cable post 30*a*. By associating cable retainer 115 with two openings 112 near top 110, cable 34 may couple to cable post 30*a* at a respective position from ground level. Alternatively, cable retainer 115 may be associated with lower openings 112 for coupling cables 36 or 38 to a position closer to ground level.

Figure 14:
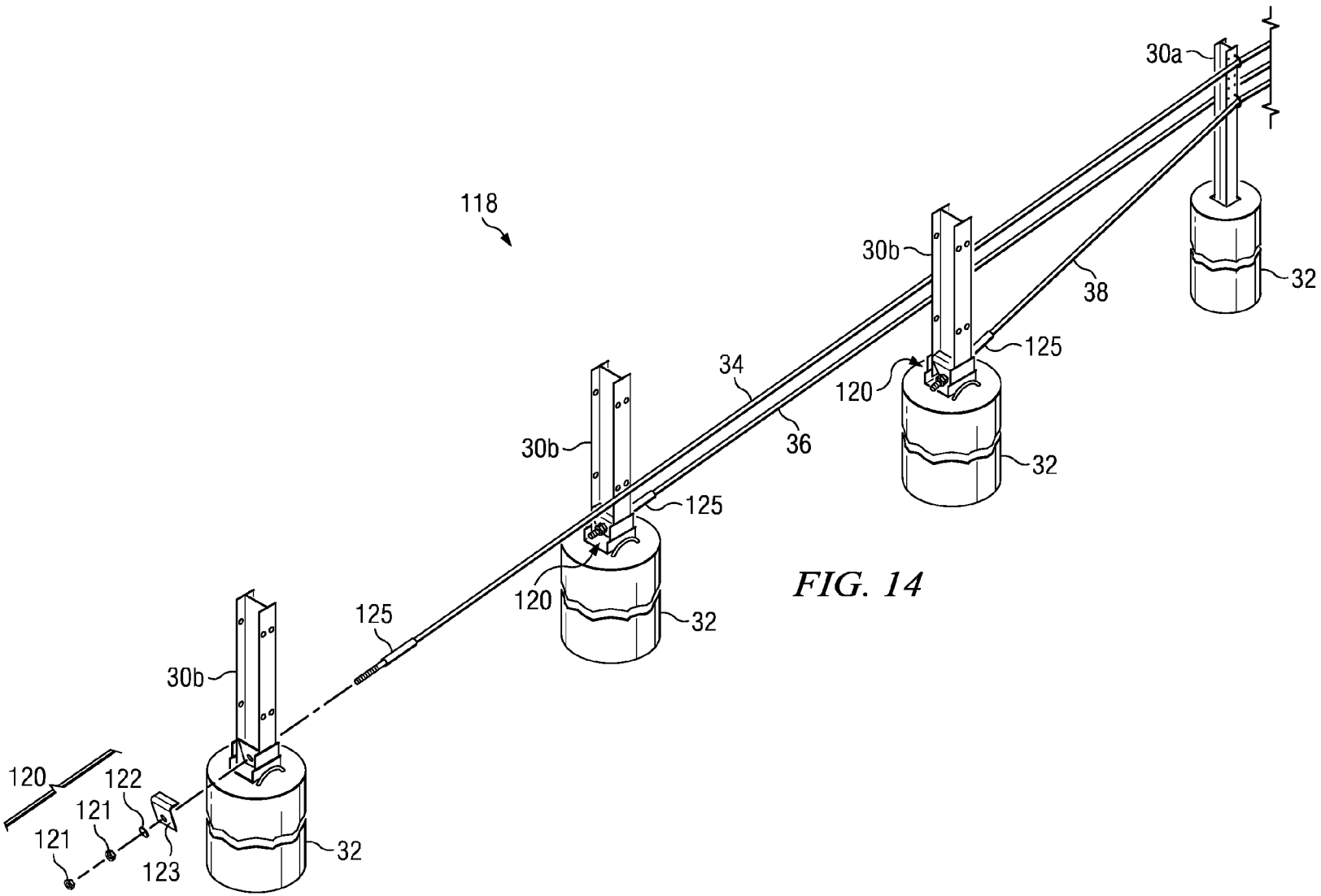
FIG. 14 is a schematic drawing in section and in elevation with portions broken away of a cable terminal assembly satisfactory for use with the cable safety system of FIG. 3A.

FIG. 14 shows one example of cable terminal assembly 118, which may be satisfactorily used with a combined guardrail and cable safety system incorporating teachings of the present disclosure. In addition to below-ground anchor 100, cable terminal assembly 118 may also be used to terminate a cable safety system.

As shown in the example embodiment, cable posts 30*b* may couple to foundation tubes such as concrete tubes 32 such that cable posts 30*b* may be formed as breakaway posts. Cables 34, 36 and 38 may be attached to respective cable posts 30*b* and may be secured with cable bracket post assemblies 120. Each cable post 30*b* may be associated with one cable bracket post assembly 120 that secures a respective cable. For example, in a cable safety system having three cables, cable terminal assembly 118 may include three cable post 30*b* each used to secure one of the three cables.

Each cable 34, 36 and 38 may include a cable termination such as threaded cable termination 125 that permits cable 34, 36 and 38 to couple to their respective cable posts 30*b*. Threaded cable termination 125 of each cable may extend through an slot or opening (not expressly shown) in cable post 30*b* allowing for connection to cable bracket post assembly 120. Cable bracket post assembly 120 may include bracket 123, washer 122 and nuts 121.

Although the present disclosure and its advantages have been described in detail, it should be understood that various changes, substitutions and alternations can be made herein without departing from the spirit and scope of the disclosure as defined by the following claims.

What is claimed is:

1. A safety barrier comprising:

a plurality of cable posts spaced from each other and disposed adjacent to a roadway;

at least two cables releasably engaged with and supported by the cable posts;

the cable posts and the at least two cables cooperating with each other to prevent a vehicle from leaving the roadway;

a plurality of guardrail posts spaced from each other and disposed adjacent to the roadway longitudinally spaced from the plurality of cable post;

a box beam guardrail beam attached to the plurality of guardrail posts, the box beam guardrail beam having at least two faces; and the at least two cables operably extending from the cable posts to engage respective cable anchor brackets attached to the box beam guardrail beam, the respective cable anchor brackets attached to different faces of the box beam guardrail beam such that each of the at least two cables engages its respective cable anchor bracket adjacent to different faces of the box beam guardrail beam.

2. The safety barrier of claim 1, further comprising:

at least one of the cable posts having a slot formed therein and extending from an upper end of the cable post;

the slot operable to slidably receive the at least two cables therein; and at least one spacer disposed within the cable post to maintain the cables at a desired location within the slot.

3. The safety barrier of claim 2, further comprising:

at least a first cable, second cable, and third cable disposed with each slot;

a respective first spacer disposed within each cable post between the first cable and the second cable; and a respective second spacer disposed within each cable post between the second cable and the third cable.

4. The safety barrier of claim 1, further comprising:

at least one retaining band secured to the exterior of the post to aid in releasably engaging the cables with the cable post; and a respective cap releasably secured with an upper end of the post.

* * * * *